US008952948B2

(12) United States Patent
Moon et al.

(10) Patent No.: US 8,952,948 B2
(45) Date of Patent: Feb. 10, 2015

(54) LIQUID CRYSTAL DISPLAY DEVICE

(75) Inventors: Myung Kook Moon, Daegu (KR); Hyun Taek Nam, Daegu (KR); Jong Woo Kim, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 535 days.

(21) Appl. No.: 13/292,892

(22) Filed: Nov. 9, 2011

(65) Prior Publication Data

US 2012/0133627 A1 May 31, 2012

(30) Foreign Application Priority Data

Nov. 26, 2010 (KR) ..... 10-2010-0119082

(51) Int. Cl.
*G09G 5/00* (2006.01)
*G09G 3/34* (2006.01)
*G09G 3/36* (2006.01)

(52) U.S. Cl.
CPC ..... *G09G 3/3648* (2013.01); *G09G 3/3614* (2013.01); *G09G 3/3677* (2013.01); *G09G 2300/0408* (2013.01); *G09G 2310/0224* (2013.01); *G09G 2310/0289* (2013.01); *G09G 2310/08* (2013.01)
USPC ..... 345/208; 345/84; 345/94

(58) Field of Classification Search
USPC ..... 345/84–104, 208
See application file for complete search history.

(56) References Cited

U.S. PATENT DOCUMENTS

| | | | | |
|---|---|---|---|---|
| 7,817,130 | B2 * | 10/2010 | Wei et al. | 345/100 |
| 7,956,855 | B2 | 6/2011 | Park | |
| 8,243,002 | B2 | 8/2012 | Shin et al. | |
| 2006/0145999 | A1 | 7/2006 | Cho et al. | |
| 2009/0278782 | A1 | 11/2009 | Chen | |
| 2010/0220079 | A1 | 9/2010 | Bang et al. | |
| 2011/0001732 | A1 * | 1/2011 | Morii et al. | 345/204 |

FOREIGN PATENT DOCUMENTS

| | | | |
|---|---|---|---|
| CN | 1904982 | A | 1/2007 |
| CN | 101436371 | A | 5/2009 |
| CN | 101577104 | A | 11/2009 |
| CN | 101582686 | A | 11/2009 |
| KR | 10-2008-0088038 | A | 10/2008 |

* cited by examiner

*Primary Examiner* — Kent Chang
*Assistant Examiner* — Scott Au
(74) *Attorney, Agent, or Firm* — Birch, Stewart, Kolasch & Birch, LLP

(57) ABSTRACT

An LCD device is discussed in which a level shifter generates two switching signals, and transmits the generated signals to a gate driver of a liquid crystal display panel by the use of one voltage signal transmitted from a timing controller. The LCD device according to an embodiment includes a liquid crystal display panel in which a gate driver for alternately driving two transistors is formed; a data driver which drives data lines of the liquid crystal display panel; a timing controller which generates one voltage signal for switching the two transistors, and outputs the one voltage signal; and a level shifter which generates two of first and second switching signals to switch the two transistors by using the one voltage signal, and outputs the generated switching signals to the gate driver.

6 Claims, 5 Drawing Sheets

LIQUID CRYSTAL DISPLAY DEVICE

CROSS REFERENCE TO RELATED APPLICATIONS

This application claims the benefit of the Korean Patent Application No. 10-2010-0119082 filed on Nov. 26, 2010, which is hereby incorporated by reference as if fully set forth herein.

BACKGROUND OF THE INVENTION

1. Field of the Invention

The present invention relates to a liquid crystal display (LCD) device, and more particularly, to an LCD device including a timing controller with the decreased number of pins.

2. Discussion of the Related Art

In an LCD device with liquid crystal having dielectric anisotropy, an image is displayed by controlling a light transmittance in the liquid crystal. For this, the LCD device includes a liquid crystal display panel with a plurality of pixels arranged in a matrix configuration; and a driving circuit for driving the liquid crystal display panel.

On a display area of the liquid crystal display panel, there are the plurality of pixels defined by gate and data lines crossing each other. Adjacent to a crossing portion of the gate and data lines, there is a thin film transistor (TFT) which is turned-on depending on a scan signal of the gate line to apply a data signal of the data line to each pixel electrode.

The driving circuit includes a gate driver for driving the gate line of the liquid crystal display panel; a data driver for driving the data line; a timing controller for controlling a driving timing in the gate driver and data driver; and a power source for supplying signals needed to drive the liquid crystal display panel and driver.

The gate driver shifts a gate start pulse outputted from the timing controller depending on a gate shift clock, whereby a scan pulse with a gate-on voltage is sequentially supplied to the gate line, and a gate-off voltage is supplied for a period which is not supplied with the scan pulse. In this case, a voltage level of gate shift clock signal outputted from the timing controller is changed by a level shifter, and then the gate shift clock signal with the changed voltage level is supplied to the gate driver.

The gate driver requires the plurality of gate shift clock signals to drive the gate line. Thus, the timing controller has to generate and output the plurality of clock signals. In this respect, the number of output pins in the timing controller is increased. Also, since the plurality of gate shift clock signals are supplied to the gate driver via the level shifter, the number of input pins in the level shifter is increased. For generating the plurality of gate shift clock signals, a circuit structure of the timing controller is complicated, thereby increasing the cost.

FIG. 1 is an exemplary view illustrating a pin connection structure among a timing controller, a level shifter (P-IC), and a liquid crystal display panel in a related art LCD device.

The timing controller generates a start pulse (VST), and a plurality of gate shift clocks (O_GCLK1, 2, 3, 4); and outputs them to the level shifter (P-IC). Also, the timing controller generates switching signals (VDD_E, VDD_O) for an alternate use with TFT so as to reduce a TFT stress of GIP (Gate-In-Panel); and outputs the generated switching signals to the level shifter.

At this time, if VDD_E is high, the first TFT is turned-on and driven; and the second TFT is turned-off. Meanwhile, if VDD_O is high, the first TFT is turned-off; and the second TFT is turned-on and driven.

Meanwhile, the level shifter (Power-IC) receives the VDD_E and VDD_O from the timing controller; and transmits the received VDD_E and VDD_O to the GIP of the liquid crystal display panel.

That is, in case of the GIP of the liquid crystal display panel, the first TFT and second TFT are used while being switched by the two switching signals transmitted from the level shifter. The first TFT and second TFT indicate pull-down transistors in the shift register of the GIP.

In more detail, the GIP outputs the scan signal to each gate line during 1 horizontal period so as to turn-on the switching device (TFT) in each pixel; and outputs a discharging voltage (gate-off voltage) to each gate line during the rest period of 1 frame except the 1 horizontal period so as to turn-off the switching device (TFT). For the output of the discharging voltage, the pull-down transistor in the shift register of the GIP should output the discharging voltage continuously for the rest period of 1 frame except the 1 horizontal period so that the pull-down transistor receives lots of stress. Accordingly, the two pull-down transistors are alternately used so as to prevent the excessive stress.

The related art timing controller transmits the switching signals (VDD_O, VDD_E) enabling to alternately use the two pull-down transistors to the GIP. For this, as shown in FIG. 1, there are additionally-provided two pins for transmitting the switching signal between the timing controller and the level shifter (Power-IC).

As mentioned above, the two pins for transmitting the switching signals should be formed in the related art LCD device, whereby pin and package loss may exist in the timing controller and level shifter.

FIG. 2 is an exemplary view illustrating waveform of signals outputted from the timing controller of the related art LCD device, especially, FIG. 2 illustrates waveform of the two switching signals (VDD_EVEN, VDD_ODD) for controlling the TFT of the GIP liquid crystal display panel.

The related art timing controller and level shifter include the two pins for outputting the VDD_E and VDD_O to thereby switch the two transistors of the GIP. The two pins output the lowest-positioned two waveforms (VDD_EVEN, VDD_ODD) shown in FIG. 2.

That is, as mentioned above, the related art LCD device includes the two pins for transmitting the switching signals via the two lines. Thus, the related art LCD device has the process difficulties and various problems on the arrangement of elements on a PCB.

SUMMARY OF THE INVENTION

Accordingly, the present invention is directed to an LCD device that substantially obviates one or more problems due to limitations and disadvantages of the related art.

An aspect of the present invention is to provide an LCD device in which a level shifter generates two switching signals, and transmits the generated signals to a gate driver of a liquid crystal display panel by the use of one voltage signal transmitted from a timing controller.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an LCD device comprising: a liquid crystal display panel in which a gate driver for alternately driving two transistors is formed; a data driver which drives data lines of the liquid crystal display panel; a timing controller which generates one voltage signal for switching the two transistors, and outputs the one voltage signal; and a level shifter which generates two of first and second switching signals to switch the two transistors by using the one voltage signal, and outputs the generated switching signals to the gate driver.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, an LCD device according to the present invention will be described with reference to the accompanying drawings.

Figure 1:
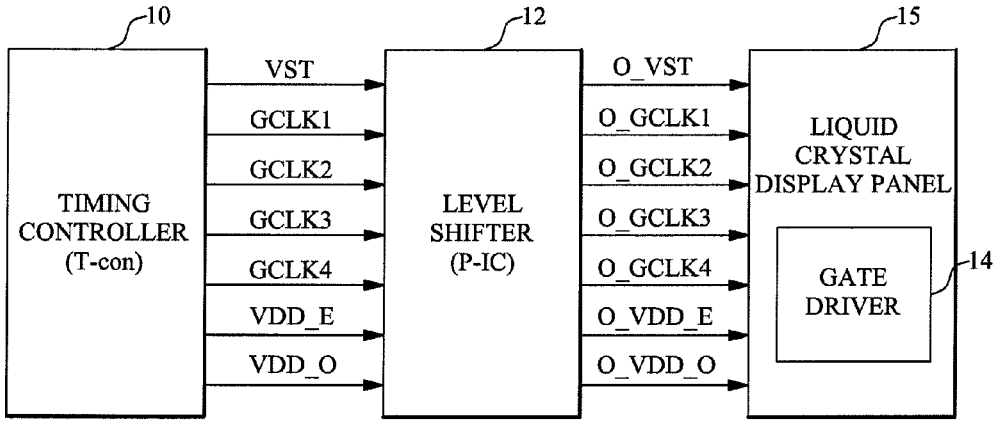
FIG. 1 is an exemplary view illustrating a pin connection structure among a timing controller, a level shifter (P-IC), and a liquid crystal display panel in a related art LCD device.
Figure 2:
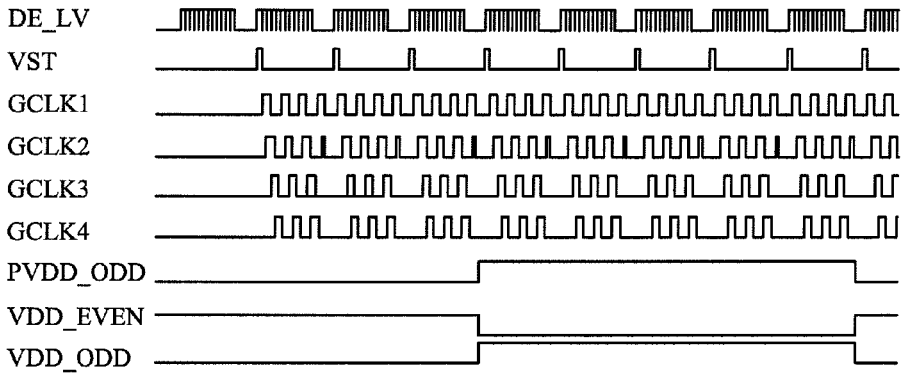
FIG. 2 is an exemplary view illustrating waveform of signals outputted from a timing controller of a related art LCD device.
Figure 3:
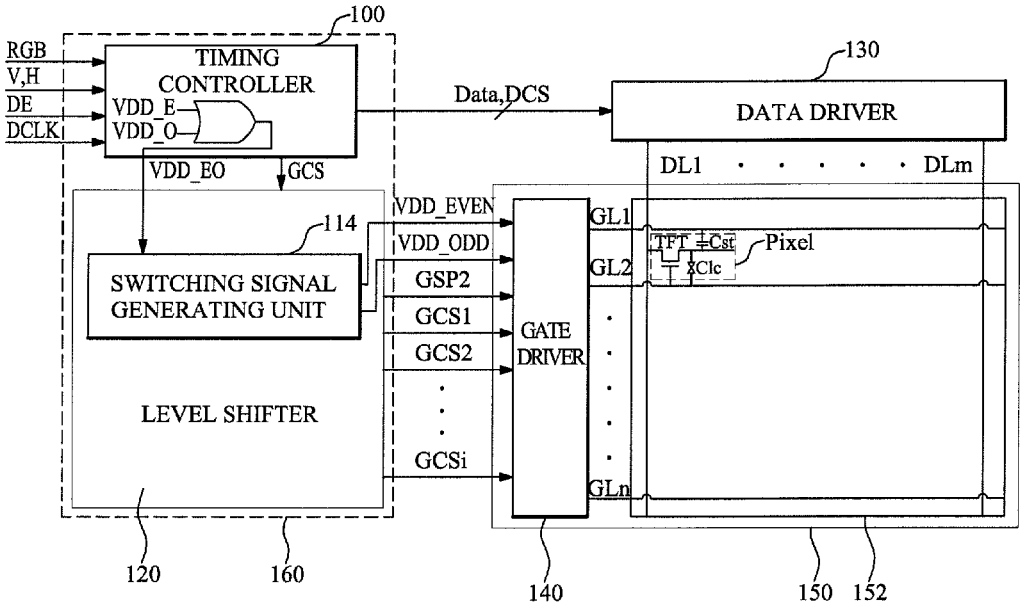
FIG. 3 is an exemplary view illustrating an LCD device according to the present invention.
Figure 4:
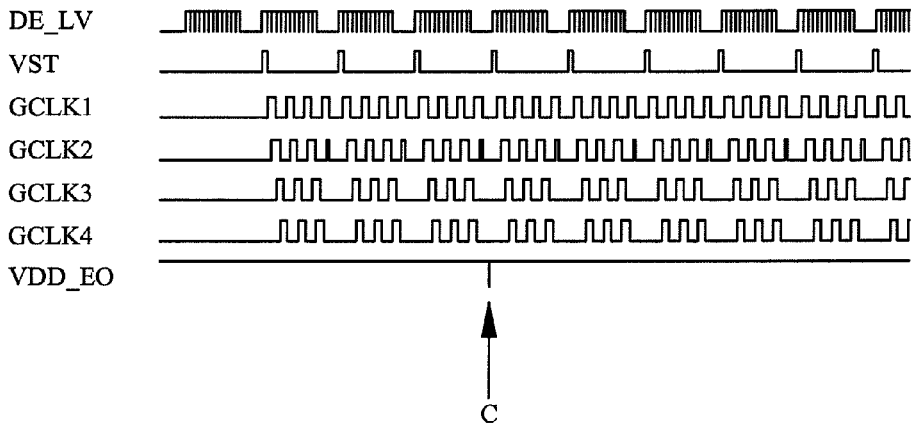
FIG. 4 is an exemplary view illustrating waveform of signals outputted from a timing controller of an LCD device according to the present invention.

FIG. 3 is an exemplary view illustrating an LCD device according to the present invention. FIG. 4 is an exemplary view illustrating waveform of signals outputted from a timing controller of an LCD device according to the present invention.

As shown in FIG. 3, the LCD device according to the present invention includes a data driver 130 for driving data lines (DL1 to DLm); a liquid crystal display panel 150 with a gate driver 140 for driving gate lines (GL1 to GLn); and a control board 160 on which a level shifter 120 and a timing controller 100 are mounted, wherein the level shifter 120 controls the gate driver 140, and the timing controller controls the level shifter 120 and the data driver 130.

First, the liquid crystal display panel 150 is divided into a display area 152 and a non-display area, wherein the non-display area is formed in the periphery of the display area 152. The liquid crystal display panel 150 includes the gate lines (GL1 to GLn) and data lines (DL1 to DLm), the gate and data lines crossing each other to define a pixel region; a thin film transistor (TFT) formed adjacent to a crossing portion of the gate and data lines; a liquid crystal capacitor (Clc) formed in each pixel region and connected with each thin film transistor (TFT); and a storage capacitor (Cst) connected in parallel with the liquid crystal capacitor (Clc). The liquid crystal capacitor (Clc) is formed of liquid crystal positioned between a common electrode and a pixel electrode connected with the thin film transistor (TFT). As the thin film transistor (TFT) is turned-on by a gate-on voltage from the gate line (GL1 to GLn), a data voltage outputted from the data line (DL1 to DLm) is supplied to the pixel electrode, whereby the liquid crystal capacitor (Clc) is charged with a differential voltage between the data voltage and a common voltage (Vcom). The thin film transistor (TFT) is turned-off by a gate-off voltage (Voff) outputted from the gate line (GL1 to GLn) to thereby maintain the voltage charged in the liquid crystal capacitor (Clc). At this time, the storage capacitor (Cst) makes it possible to stably maintain the voltage charged in the liquid crystal capacitor (Clc).

On the non-display area of the liquid crystal display panel 150, the gate driver 140 is formed in type of GIP. The gate driver 140 shifts a gate start pulse (GSP) transmitted from the level shifter 120 depending on a gate shift clock (GSC); and sequentially supplies a scan pulse having a gate-on voltage (Von) to the gate lines (GL1 to GLn). Also, the gate driver 140 supplies a gate-off voltage (Voff) to the gate lines (GL1 to GLn) for the rest period which is not supplied with the scan pulse of the gate-on voltage (Von).

As mentioned above, the gate driver 140 (GIP) of the liquid crystal display panel outputs the scan pulse to each gate line for 1 horizontal period so as to turn-on the switching device (thin film transistor) in each pixel; and supplies the gate-off voltage (Voff) for the reset period which is not supplied with the scan pulse. At this time, the two pull-down transistors for supplying the gate-off voltage (Voff) are formed and alternately used in the gate driver 140, to thereby reduce stress applied to the pull-down transistors. By the use of voltage signal (VDD_EO) transmitted from the timing controller 100, the two pull-down transistors alternately used depending on two switching signals (VDD_ODD, VDD_EVEN) generated and outputted by the level shifter 120.

The data driver 130 generates a sampling signal by shifting a source start pulse (SSP) transmitted from the timing controller 100 depending on a source shift clock (SSC). Also, the data driver 130 latches pixel data (RGB), which is inputted depending on the source shift clock (SSC), according to the sampling signal; and supplies the latched pixel data to each horizontal line in response to a source output enable signal (SOE). Then, the data driver 130 converts the pixel data (RGB) supplied for each horizontal line into an analog pixel signal by the use of gamma voltage generated by a gamma generator (not shown); and supplies the analog pixel signal to the data lines (DL1 to DLm). At this time, the data driver 130 determines a polarity of the corresponding pixel in response to a polarity control signal (POL) transmitted from the timing controller 100 when the pixel data (RGB) is converted into the pixel signal. Also, the data driver 130 determines a period for supplying the pixel signal to the data line (DL1 to DLm) in response to the source output enable signal (SOE).

The timing controller 100 generates a data control signal (DCS) for controlling the data driver 130 by the use of vertical synchronous signal (V), horizontal synchronous signal (H), data enable (DE), and dot clock (DCLK); and simultaneously generates a gate control signal (GCS) for controlling the level shifter 120 and gate driver 140. The data control signal (DCS) may include the source shift clock (SSC), source start pulse (SSP), polarity control signal (POL), and source output enable signal (SOE). The gate control signal (GCS) may include first and second gate start pulses (GSP1, GSP2), clock signal (RCLK), and gate output enable signal (GOE). At this time, the clock signal (RCLK), first gate start pulse (GSP1), and gate output enable signal (GOE) are supplied to the level shifter 120; and the second gate start pulse (GSP2) is supplied to the gate driver 140 via the level shifter 120.

The timing controller 100 outputs one voltage signal (VDD_EO) for alternately using the two transistors of the gate driver 140. That is, as shown in FIGS. 3 and 4, the timing controller 100 outputs one voltage signal (VDD_EO) obtained by combining the two switching signals (VDD_E, VDD_O) which enable to alternately drive the two transistors of the gate driver 140; and supplies the generated voltage signal (VDD_EO) to the level shifter 120 via one pin.

The level shifter 120 includes a gate shift clock generating unit (not shown) for generating the plurality of gate shift clock signals (GSC1 to GSCi) by the use of one clock signal (RCLK) and the first gate start pulse (GSP1); a level-shifting unit (not shown) for level-shifting the plurality of gate shift clock signals (GSC1 to GSCi), adjusting a pulse width of the plurality of gate shift clock signals (GSC1 to GSCi) depending on the gate output enable signal (GOE), and supplying the gate shift clock signals level-shifted and adjusted in pulse width to the gate driver 140; and a switching signal generating unit 114 for generating the two switching signals by the use of voltage signal transmitted from the timing controller 100.

The gate shift clock generating unit (not shown) generates the plurality of gate shift clock signals (GSC1 to GSCi, wherein 'i' is an integer above 2) sequentially shifted by the use of one clock signal (RCLK) and the first gate start pulse (GSP1).

The level-shifting unit (not shown) level-shifts the plurality of gate shift clock signals (GSC1 to GSCi); and outputs the level-shifted gate shift clock signals. Also, the level-shifting unit adjusts the pulse width of the plurality of gate shift clock signals (GSC1 to GSCi) in response to the gate output enable signal (GOE). At this time, the level-shifting unit reduces the pulse width of the first to (i)th gate shift clock signals (GSC1 to GSCi) in accordance with the gate output enable signal (GOE) before or after the plurality of gate shift clock signals (GSC1 to GSCi) are level-shifted.

As mentioned above, the switching signal generating unit 114 generates the two switching signals by the use of voltage signal (VDD_EO) transmitted from the timing controller 100. This will be explained with reference to FIGS. 5 and 6. The switching signal generating unit 114 may be independently provided from the gate shift clock generating unit and level-shifting unit in the level shifter 120; or may be formed inside the gate shift clock generating unit or level-shifting unit.

Figure 5:
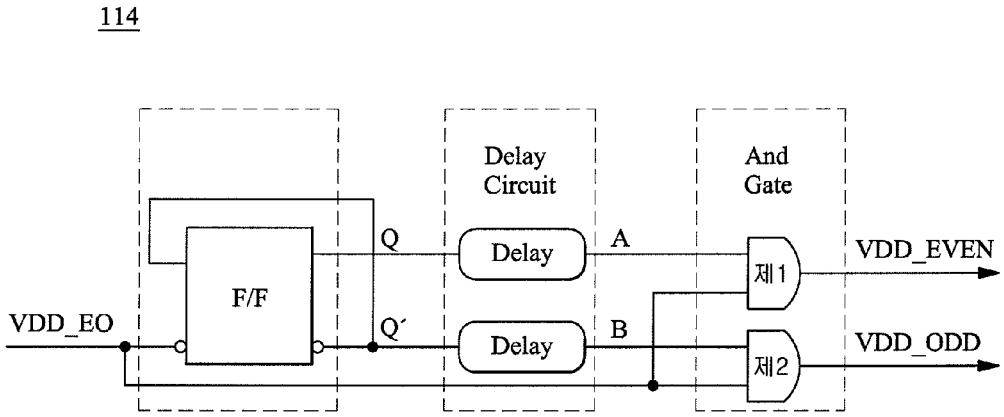
FIG. 5 is an exemplary view illustrating a structure of a switching signal generating unit in a level shifter of an LCD device according to the present invention.
Figure 6:
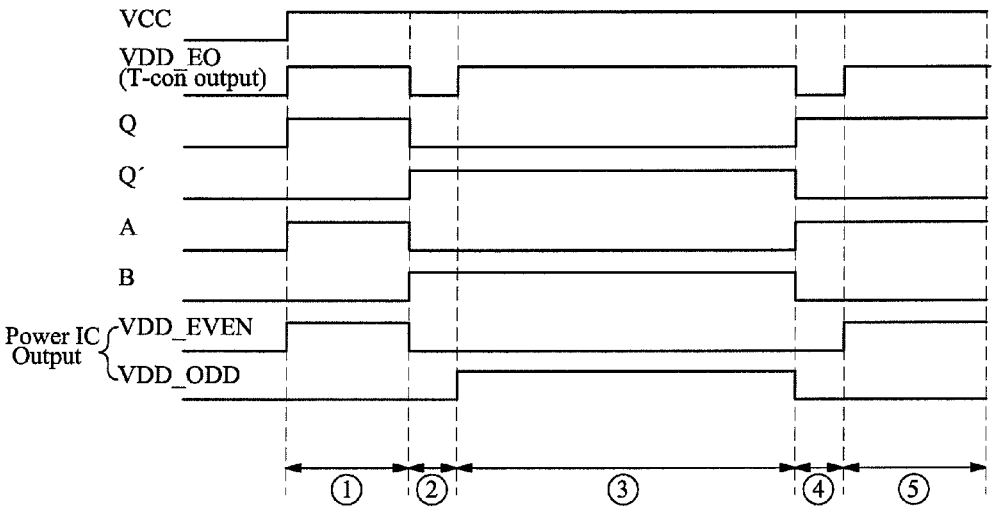
FIG. 6 is an exemplary view illustrating waveform of signals inputted to and outputted from a switching signal generating unit of FIG. 5.

FIG. 5 is an exemplary view illustrating a structure of the switching signal generating unit in the level shifter of the LCD device according to the present invention. FIG. 6 is an exemplary view illustrating waveform of signals inputted to and outputted from a switching signal generating unit of FIG. 5.

That is, the switching signal generating unit 114 is formed in the level shifter 120 applied to the LCD device according to the present invention, wherein the switching signal generating unit 114 outputs the two switching signals (VDD_EVEN, VDD_ODD) by the use of one voltage signal (VDD_EO) transmitted from the timing controller 100. As shown in FIG. 5, the switching signal generating unit 114 comprises a flip-flop (F/F), two delay circuits, and two And-Gates.

The flip-flop (F/F) receives the voltage signal (VDD_EO) transmitted from the timing controller 100, and outputs the two output signals (Q, Q'). The second output signal (Q') of the two output signals (Q, Q') is again inputted to the flip-flop (F/F).

The respective two delay circuits (first delay circuit and second delay circuit) delays the first output signal (Q) and second output signal (Q') of the flip-flop (F/F).

The first And-Gate receives the control signal (VDD_EO) and first output signal (Q) of the flip-flop via the first delay circuit; and outputs the VDD_EVEN signal. The second And-Gate receives the control signal (VDD_EO) and second output signal (Q') of the flip-flop via the second delay circuit; and outputs the VDD_ODD signal. At this time, the VDD_EVEN signal indicates the signal (hereinafter, referred to as 'first switching signal') for switching and driving the first transistor of the two transistors of the gate driver 140; and the VDD_ODD signal indicates the signal (hereinafter, referred to as 'second switching signal) for switching and driving the second transistor.

A method for generating the two switching signals by the use of one control signal in the switching signal generating unit 114 having the above structure will be explained as follows by referring to FIG. 6.

First, during a first block (①), when the control signal (VDD_EO) of a high level is inputted to the flip-flop (F/F), the first output signal (Q) of the flip-flop (F/F) is outputted while being a high level; and the second output signal (Q') is outputted while being a low level. Thus, the first delay circuit outputs a first delay signal (A) of a high level; and the second delay circuit outputs a second delay signal (B) of a low level.

At this time, the first And-Gate receives the first delay signal (A) of the high level, and the control signal of the high level. Then, the first And-Gate performs an AND logical operation, to thereby output the first switching signal of a high level (VDD_EVEN). The second And-Gate receives the second delay signal (B) of the low level, and the control signal of the high level. Then, the second And-Gate performs an AND logical operation, to thereby output the second switching signal of a low level (VDD_ODD). At this time, the first transistor of the gate driver 140 is turned-on by the first switching signal transmitted from the level shifter 120 (more particularly, switching signal generating unit 114), whereby the gate-off voltage (scan pulse) is transmitted to the gate line, and the second transistor is turned-off by the second switching signal.

During a second block (②), when the control signal is converted into the low level at 'C' point of FIG. 4, the first output signal (Q) of the low level and the second output signal (Q') of the high level are outputted. Also, the first delay circuit outputs the first delay signal (A) of the low level; and the second delay circuit outputs the second delay signal (B) of the high level.

At this time, the first And-Gate receives the control signal of the low level, and the first delay signal (A) of the low level. Then, the first And-Gate performs an AND logical operation, to thereby output the first switching signal of a low level (VDD_EVEN). The second And-Gate receives the second delay signal (B) of the high level, and the control signal of the low level. Then, the second And-Gate performs an AND logical operation, to thereby output the second switching signal of a low level (VDD_ODD). At this time, both the first and second transistors of the gate driver 140 are turned-off. At this time, the second block (②) during which both the first and second transistors are turned-off corresponds to a period during which image is not outputted between each frame.

During a third block (③), when the control signal (VDD_EO) of the high level is inputted to the flip-flop (F/F), the first output signal (Q) of the low level and the second output signal (Q') of the high level are outputted. Also, the first delay circuit outputs the first delay signal (A) of the low level; and the second delay circuit outputs the second delay signal (B) of the high level.

At this time, the first And-Gate receives the control signal of the high level, and the first delay signal (A) of the low level. Then, the first And-Gate performs an AND logical operation, to thereby output the first switching signal of a low level (VDD_EVEN). The second And-Gate receives the second delay signal (B) of the high level, and the control signal of the high level. Then, the second And-Gate performs an AND logical operation, to thereby output the second switching signal of a high level (VDD_ODD). At this time, the second transistor of the gate driver 140 is turned-on by the second switching signal transmitted from the level shifter 120 (more particularly, switching signal generating unit 114), whereby the gate-off voltage (scan pulse) is transmitted to the gate line, and the first transistor is turned-off by the first switching signal.

A fourth block (④) is identical to the second block (②), which corresponds to a period during which image is not outputted between each frame. During the fourth block (④), both the first and second transistors are turned-off.

From a fifth block (⑤), the process of the first block (①) is repeated again. Thus, the first and second transistors of the gate driver 140 are driven alternately.

Figure 7:
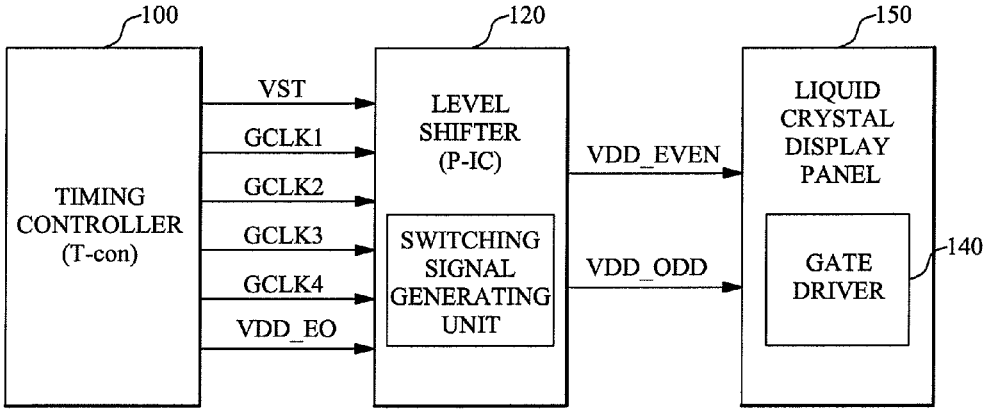
FIG. 7 is an exemplary view illustrating a pin connection structure among a timing controller, a level shifter (P-IC), and a liquid crystal display panel in an LCD device according to the present invention.

FIG. 7 is an exemplary view illustrating a pin connection structure among the timing controller, the level shifter (P-IC), and the liquid crystal display panel 150 in the LCD device according to the present invention.

The timing controller 100 of the LCD device according to the present invention generates a start signal (VST) and the plurality of gate shift clocks (O_GCLK1, 2, 3, 4); and outputs the generated signals to the level shifter (P-IC) 120. Also, the timing controller 100 generates one voltage signal (VDD_EP) for alternately driving the two pull-down transistors of the gate driver 140 of the GIP type in the liquid crystal display panel 150; and outputs the generated voltage signal to the level shifter 120. At this time, the gate shift clock and start signal transmitted from the level shifter 120 to the liquid crystal display panel 150 are not shown in FIG. 7.

The level shifter 120 amplifies the signals, and transmits the amplified signals to the gate driver 140 of the liquid crystal display panel 150. Meanwhile, the level shifter 120 generates the two switching signals (VDD_EVEN, VDD_ODD) by receiving one voltage signal (VDD_EO), and outputs the generated two switching signals to the gate driver 140.

The gate driver 140 of the LCD device according to the present invention outputs the image to the display area 152 by the use of signals. At this time, if the first switching signal (VDD_EVEN) of the two switching signals generated in the level shifter 120 is high, the first transistor of the gate driver 140 is turned-on, whereby the gate-off voltage is applied to the gate line, and the second transistor is turned-off. Also, if the second switching signal (VDD_ODD) is high, the first transistor of the gate driver 140 is turned-off, and the second transistor is turned-on, whereby the gate-off voltage is applied to the gate line.

Figure 8:
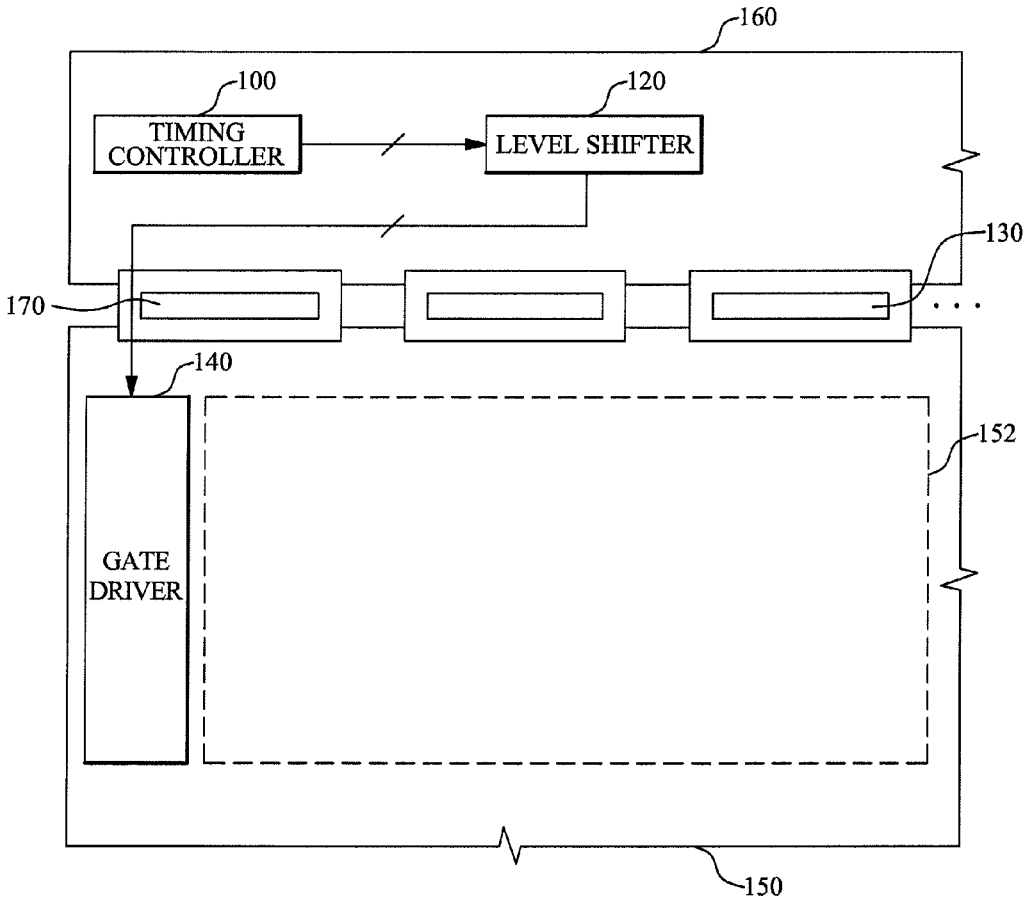
FIG. 8 is an exemplary view illustrating an arrangement of elements of an LCD device according to the present invention.

FIG. 8 is an exemplary view illustrating an arrangement of elements of the LCD device according to the present invention.

That is, the LCD device according to the present invention comprises the control board 160 on which the timing controller 100 and level shifter 120 are mounted; a data circuit film 170 on which the data driver 130 for driving the data lines (DL1 to DLm) is mounted; and the liquid crystal display panel 150 in which the gate driver 140 is formed.

The timing controller 100 supplies the data control signal for controlling the data driver 130 to the data driver 130 via the data circuit film 170. Also, the timing controller 100 supplies the gate control signal (GCS) for controlling the gate driver 140 and level shifter 120 to the level shifter 120. The gate control signal (GCS) may include the first and second gate start pulses (GSP1, GSP2), clock signal (RCLK), and gate output enable (GOE). The timing controller 100 generates the voltage signal (VDD_EO) for alternately switching the two transistor (pull-down transistors); and transmits the generated voltage signal to the level shifter 120, wherein the two transistors are formed in the gate driver 140, and the two transistors supply the gate-off voltage to each gate line.

The level shifter 120 generates the first to fourth gate shift clocks (GSC1 to GSC4) by the use of clock signal (RCLK) and first gate start pulse (GSP1) transmitted from the timing controller 100; and level-shifts and outputs the generated first to fourth gate shift clocks (GSC1 to GSC4) and second gate start pulse (GSP2). Also, the level shifter 120 generates the two switching signals (VDD_EVEN, VDD_ODD) by the use of voltage signal transmitted from the timing controller 100; and outputs the generated two switching signals to the gate driver 140 of the liquid crystal display panel 150.

The gate driver 140 includes a shift register with a plurality of stages. Each of the stages outputs the scan pulse by using any one among the first to fourth gate shift clock signals (GSC1 to GSC4) in response to the input signal (that is, the second gate start pulse or prior scan pulse).

As the number of pins in the timing controller 100 and level shifter 120 is reduced in the LCD device according to the present invention, it enables to simplify the connection structure between the timing controller 100 and the level shifter 120.

Accordingly, the level shifter 120 generates the two switching signals by using one voltage signal transmitted from the timing controller 100, and transmits the generated two switching signals to the gate driver 140 of the liquid crystal display panel 150 so that it is possible to reduce the number of output pins provided between the timing controller 100 and the level shifter 120.

Also, while the related art timing controller uses the two output pins, the timing controller 100 of the present invention uses one output pin. In addition, the number of the output pins in the level shifter 120 according to the present invention is also reduced to one.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An LCD device comprising:

a liquid crystal display panel in which a gate driver for alternately driving two transistors is formed;

a data driver which drives data lines of the liquid crystal display panel;

a timing controller which generates one voltage signal for switching the two transistors, and outputs the one voltage signal; and a level shifter which comprises a switching signal generating unit generating two of first and second switching signals to switch the two transistors by using the one voltage signal, and outputs the generated switching signals to the gate driver, wherein the switching signal generating unit comprises:

a flip-flop which receives the voltage signal, and outputs first output signal (Q) and second output signal (Q');

first and second delay circuits which respectively delay the first output signal and second output signal;

a first And-Gate which performs an AND logical operation for the voltage signal and a first delay signal (A) outputted from the first delay circuit; and a second And-Gate which performs an AND logical operation for the voltage signal and a second delay signal (B) outputted from the second delay circuit.

2. The LCD device according to claim 1, wherein the two transistors are first and second transistors for alternately supplying a gate-off voltage to a gate line.

3. The LCD device according to claim 2, wherein the first transistor driven by the first switching signal applies the gate-off voltage to the gate line, and the second transistor driven by the second switching signal applies the gate-off voltage to the gate line.

4. The LCD device according to claim 1, wherein the timing controller generates the one voltage signal by combining first and second voltage signals to switch the two transistors, and outputs the one voltage signal to the level shifter via one output pin.

5. The LCD device according to claim 1, wherein the switching signal generating unit is formed in a gate shift clock generating unit of the level shifter or a level-shifting unit of the level shifter.

6. The LCD device according to claim 1, wherein the second output signal is again inputted to the flip-flop while serving as another input signal.

* * * * *